US010164372B1

(12) United States Patent
Liao et al.

(10) Patent No.: US 10,164,372 B1
(45) Date of Patent: Dec. 25, 2018

(54) ELECTRICAL CONNECTING ASSEMBLY

(71) Applicant: Wistron Corp., New Taipei (TW)

(72) Inventors: Ping-Feng Liao, New Taipei (TW); Po-Yuan Hsu, New Taipei (TW); Chia-Cheng Su, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 15/942,233

(22) Filed: Mar. 30, 2018

(30) Foreign Application Priority Data

Dec. 11, 2017 (TW) ..... 106143330 A

(51) Int. Cl.
*H01R 13/44* (2006.01)
*H01R 13/52* (2006.01)
*H01R 13/05* (2006.01)
*H01R 13/10* (2006.01)

(52) U.S. Cl.
CPC ..... *H01R 13/5202* (2013.01); *H01R 13/052* (2013.01); *H01R 13/10* (2013.01)

(58) Field of Classification Search
CPC ..... H01R 13/4538
USPC ..... 439/140, 141
See application file for complete search history.

(56) References Cited

U.S. PATENT DOCUMENTS 3,491,326 A * 1/1970 Pfister ..... H01R 13/4538 439/141
3,742,426 A * 6/1973 Huber ..... H01R 13/635 439/141
4,142,770 A * 3/1979 Butler, Jr. ..... H01R 13/523 439/140
7,500,859 B2 * 3/2009 Dubranna ..... H01R 13/523 439/140
9,748,688 B2 * 8/2017 Hagmann ..... H01R 13/187
2015/0340803 A1 * 11/2015 Li ..... H01R 13/4538 439/141

FOREIGN PATENT DOCUMENTS

CN 103875133 A 6/2014

* cited by examiner

*Primary Examiner* — Phuong Dinh

(57) ABSTRACT

An electrical connecting assembly is provided, including a male connector and a female connector corresponding to the male connector. The male connector has a first insulating body and a conductive member protruding from the insulating body. The female connector has a second insulating body, a hollow conductive seat, a resilient element, and sliding unit. The second insulating body has an opening portion and a chamber for receiving the conductive member. The conductive seat is disposed in the chamber, the sliding unit is movably disposed in the conductive seat, and the resilient element connects the sliding unit to the conductive seat. Specifically, the internal diameter of the opening portion is shorter than the internal diameter of the conductive seat, and the resilient element forces the sliding unit to move to the opening portion, so that the sliding unit forms a seal with the opening portion.

18 Claims, 9 Drawing Sheets

ELECTRICAL CONNECTING ASSEMBLY

CROSS REFERENCE TO RELATED APPLICATIONS

The present application claims priority of Taiwan Patent Application No. 106143330, filed on Dec. 11, 2017, the entirety of which is incorporated by reference herein.

BACKGROUND OF THE INVENTION

Field of the Invention

The invention relates to an electrical connecting assembly, and more particularly to an electrical connecting assembly having dust-proof and water-resistant properties.

Description of the Related Art

The male and female connectors of a conventional electrical connecting assembly are not usually dust-proof or water-resistant. In particular, as the female connectors usually form a hole for receiving the male connectors, water and dust may easily enter the female connectors via the hole, whether in use or not, leading to safety problems such as short-circuiting or rust.

In recent years, the use of electrical connecting assemblies has become increasingly popular in the fields of precision mechanical equipment and medical instruments, and there is a demand for such mechanisms to be dust-proof and water-resistant. Hence, how to design an electrical connecting assembly with dust-proof and water-resistant properties has become a challenge.

BRIEF SUMMARY OF THE INVENTION

In view of the aforementioned problems, one object of the disclosure is to provide an electrical connecting assembly that includes a male connector and a female connector corresponding to the male connector. The male connector has a first insulating body and a conductive member protruding from the insulating body. The female connector has a second insulating body, a hollow conductive seat, a resilient element, and sliding unit. The second insulating body forms an opening portion and a chamber for receiving the conductive member. The conductive seat is disposed in the chamber, the sliding unit is movably disposed in the conductive seat, and the resilient element connects the sliding unit to the conductive seat. Specifically, the internal diameter of the opening portion is shorter than the internal diameter of the conductive seat, and the resilient element provides an elastic force to move the sliding unit to the opening portion, so that the sliding unit forms a seal with the opening portion.

In some embodiments, the sliding unit has a slider and a flexible sealing ring disposed around the slider, and when the resilient element provides the elastic force to move the sliding unit to the opening portion, the sealing ring forms a seal with an inner surface of the opening portion.

In some embodiments, the slider has a flange abutting a side surface of the opening portion to restrict the sliding unit in the opening portion when the resilient element provides the elastic force to move the sliding unit to the opening portion.

In some embodiments, the slider and the sealing ring comprise an electrically insulating material.

In some embodiments, when the conductive member is inserted through the opening portion into the chamber, the conductive member pushes the sliding unit toward the inside of the chamber and is in contact with an inner surface of the conductive seat.

In some embodiments, the sliding unit has a slider and a flexible sealing ring disposed around the slider, and when the conductive member is inserted through the opening portion into the chamber, the sealing ring forms a seal with the inner surface of the conductive seat.

In some embodiments, the first insulating body has a first end surface and a second end surface, and the second insulating body has a third end surface and a fourth end surface, wherein the conductive member extends from the first end to the second end, the opening portion is disposed on the third end surface, and the conductive seat is exposed to the fourth end surface, wherein the first end surface abuts the third surface when the male connector is joined to the female connector.

In some embodiments, a part of the conductive member forms a banana connector terminal.

In some embodiments, wherein the resilient element comprises a compression spring.

In some embodiments, wherein the first and second insulating bodies have a cylindrical structure.

Another object of the disclosure is to provide an electrical connecting assembly that includes a male connector and a female connector corresponding to the male connector. The male connector has a first insulating body and a conductive member protruding from the insulating body. The female connector has a second insulating body, a hollow conductive seat, a resilient element, and sliding unit. The second insulating body forms an opening portion and a chamber for receiving the conductive member. The conductive seat is disposed in the chamber, the sliding unit is movably disposed in the conductive seat, and the resilient element connects the sliding unit to the conductive seat. Specifically, the sliding unit has a flexible sealing ring, and when the resilient element provides an elastic force to move the sliding unit to the opening portion, the sealing ring forms a seal with the opening portion.

In some embodiments, the sliding unit further has a slider, and the sealing ring is disposed around the slider.

In some embodiments, the slider has a flange abutting a side surface of the opening portion to restrict the sliding unit in the opening portion when the resilient element provides the elastic force to move the sliding unit to the opening portion.

In some embodiments, the slider and the sealing ring comprise electrically insulating material.

In some embodiments, when the conductive member is inserted through the opening portion into the chamber, the conductive member pushes the sliding unit toward the inside of the chamber and is in contact with an inner surface of the conductive seat.

In some embodiments, the sliding unit further has a slider, and the sealing ring is disposed around the slider, wherein when the conductive member is inserted through the opening portion into the chamber, the sealing ring forms a seal with the inner surface of the conductive seat.

In some embodiments, the first insulating body has a first end surface and a second end surface, and the second insulating body has a third end surface and a fourth end surface, wherein the conductive member is extended from the first end to the second end, the opening portion is disposed on the third end surface, and the conductive seat is exposed to the fourth end surface, wherein the first end surface abuts the third surface when the male connector is joined to the female connector.

In some embodiments, a part of the conductive member forms a banana connector terminal.

In some embodiments, wherein the resilient element comprises a compression spring.

In some embodiments, the first and second insulating bodies have a cylindrical structure.

In order to illustrate the purposes, features, and advantages of the invention, the preferred embodiments and drawings of the invention are shown in detail as follows.

DETAILED DESCRIPTION OF THE INVENTION

The invention can be more fully understood by reading the subsequent detailed description and preferred embodiments with references made to the accompanying drawings.

In the following detailed description of the preferred embodiments, reference is made to the accompanying drawings, and in which specific embodiments of which the invention may be practiced are shown by way of illustration. In this regard, directional terminology, such as "top," "bottom," "left," "right," "front," "back," etc., is used with reference to the orientation of the figures being described. The components of the present invention can be positioned in a number of different orientations. As such, the directional terminology is used for the purposes of illustration and is in no way limiting.

Figure 1:
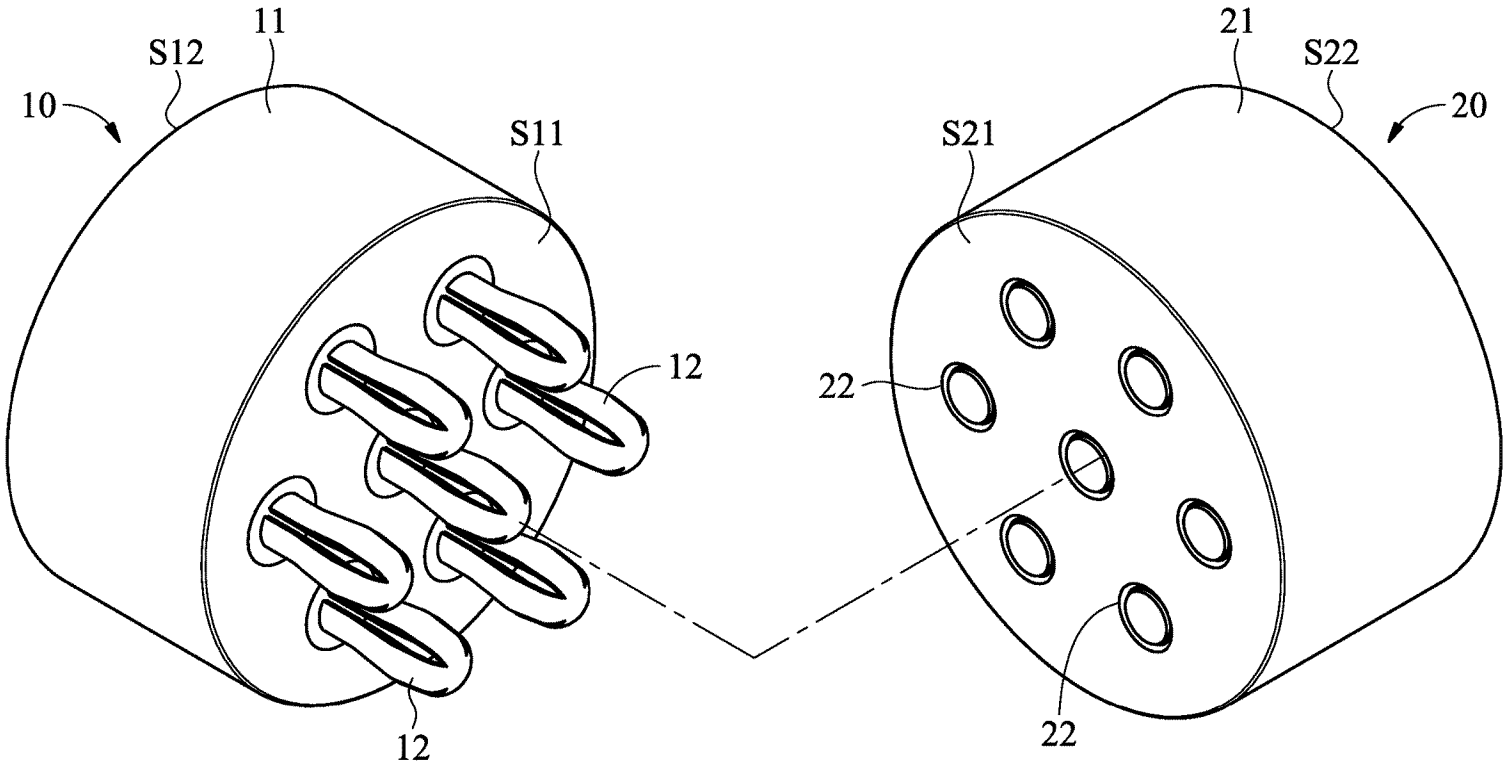
FIG. 1 is a schematic view of an electrical connecting assembly, in accordance with an embodiment of the invention.
Figure 2A:
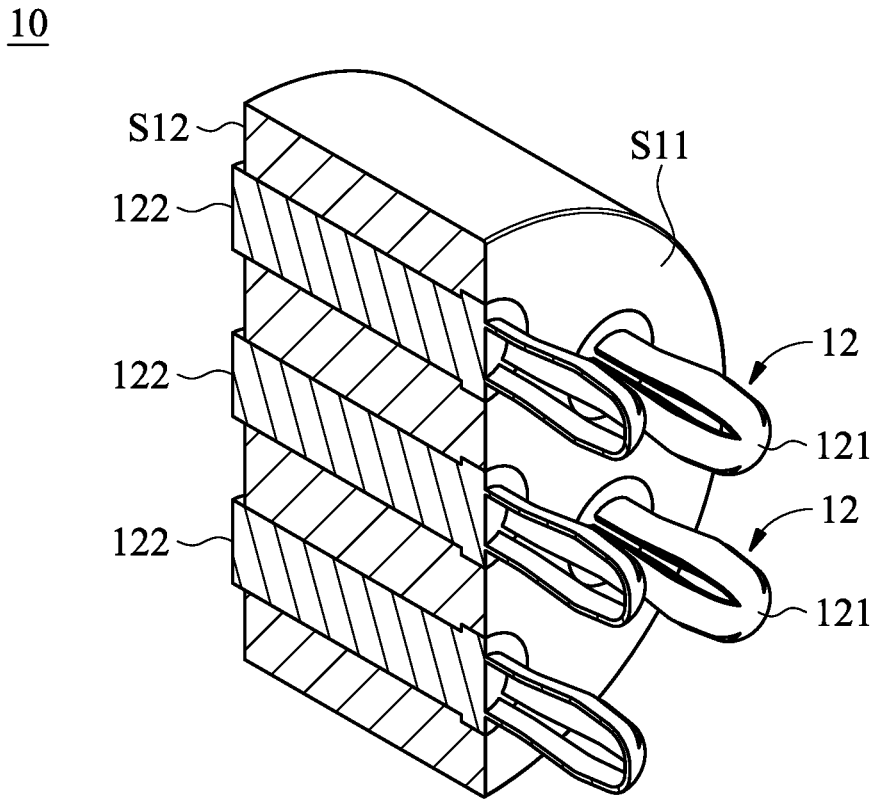
FIGS. 2A and 2B are cross-sectional views of the male connector in FIG. 1 from different viewing angles.
Figure 2B:
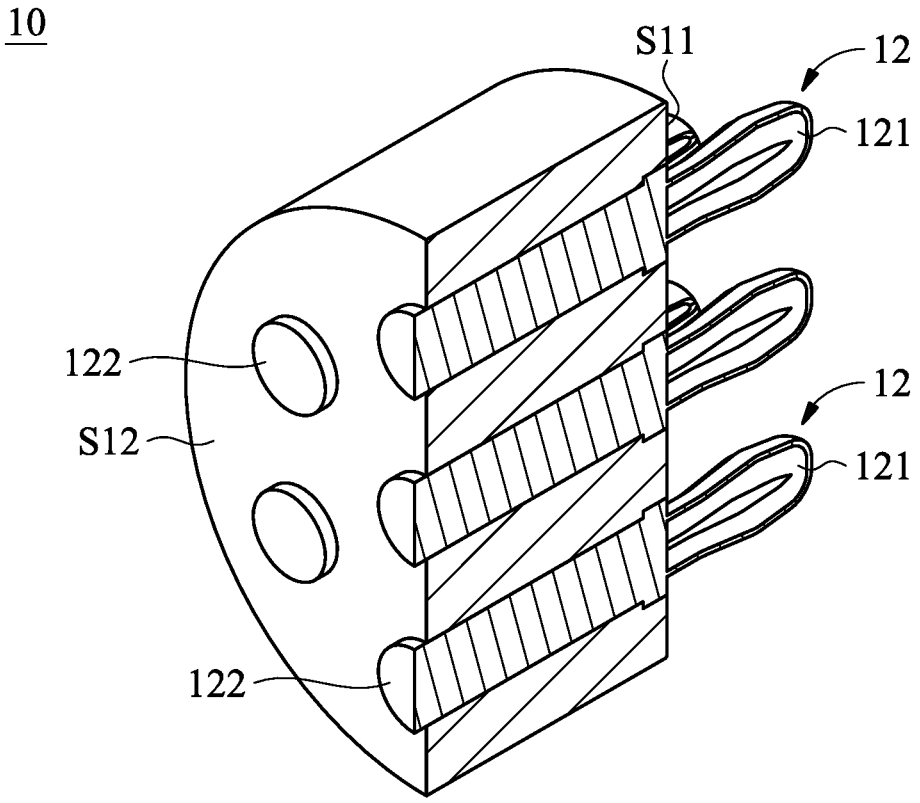
Figure 3A:
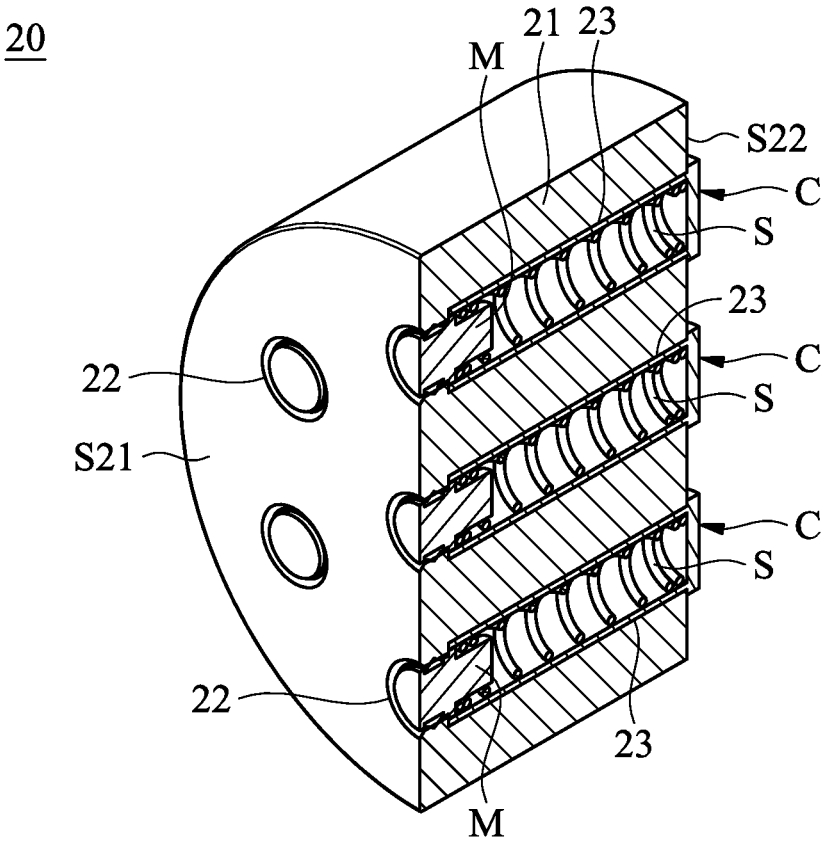
FIGS. 3A and 3B are cross-sectional views of the female connector in FIG. 1 from different viewing angles.
Figure 3B:
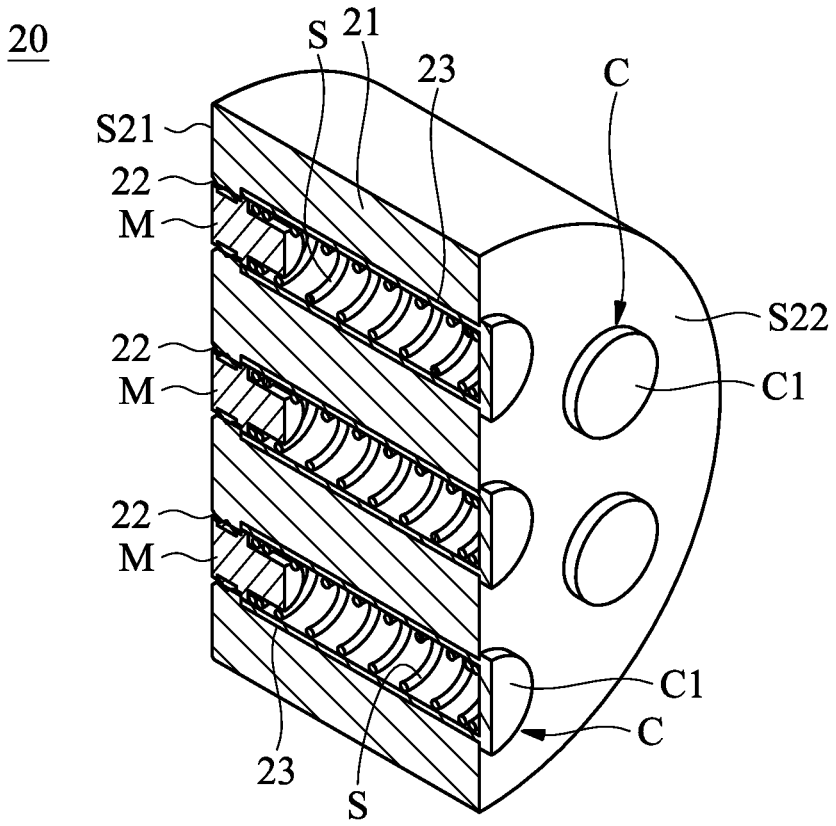

Referring to FIGS. 1, 2A and 2B, an electrical connecting assembly in accordance with an embodiment primarily comprises a male connector 10 and a female connector 20. The male connector 10 comprises a cylindrical first insulating body 11 and at least a conductive member 12 protruding from the first insulating body 11. In this embodiment, seven conductive members 12 are radially arranged on and protrude from a first end surface S11 of the first insulating body 11, wherein the male connector 10 can be electrically connected with the female connector 20 by joining the conductive members 12 to the female connector 20 via the openings 22.

FIGS. 2A and 2B show that the conductive members 12 of the male connector 10 are extended through the first insulating body 11 from the first end surface si to the second end surface S12 thereof. The conductive members 12 are insulated from each other and may comprise metal material to transmit electrical signals. Here, each conductive member 12 has a front portion 121 protruding from the first end surface S11 and constructs a banana connector terminal. Each conductive member 12 further has a rear portion 122 protruding from the second end surface S12, and the rear portion 122 can be electrically connected to an electronic device via a cable or another circuit element. It should be realized that the conductive members 12 are extended through the first insulating body 11 for electrical signal transmission, and the structure and shape thereof are not limited to the embodiment of FIGS. 1, 2A and 2B.

Referring to FIGS. 1, 3A, 3B, 4 and 5, in this embodiment, the female connector 20 corresponds to the male connector 10 and primarily comprises a cylindrical second insulating body 21, at least a hollow conductive seat C, at least a resilient element S, and at least a sliding unit M. As clearly shown in FIGS. 3A, 3B, and 5, the second insulating body 21 forms an opening portion 22 and a chamber 23 adjacent to each other. The opening portion 22 is exposed to a third end surface S21 of the second insulating body 21, and a bottom portion C1 of the conductive seat C is exposed to a fourth end surface S22 of the second insulating body 21. The bottom portion C1 of the conductive seat C can electrically connect to another electronic device via a cable or another circuit element. In this embodiment, since the first and second insulating bodies 11 and 21 both have a cylindrical structure, they can be prevented from being cracked or damaged due to stress concentration when external collisions occur. Hence, they are particularly suitable in fields with high safety requirements, such as medical and firefighting equipment.

Figure 5:
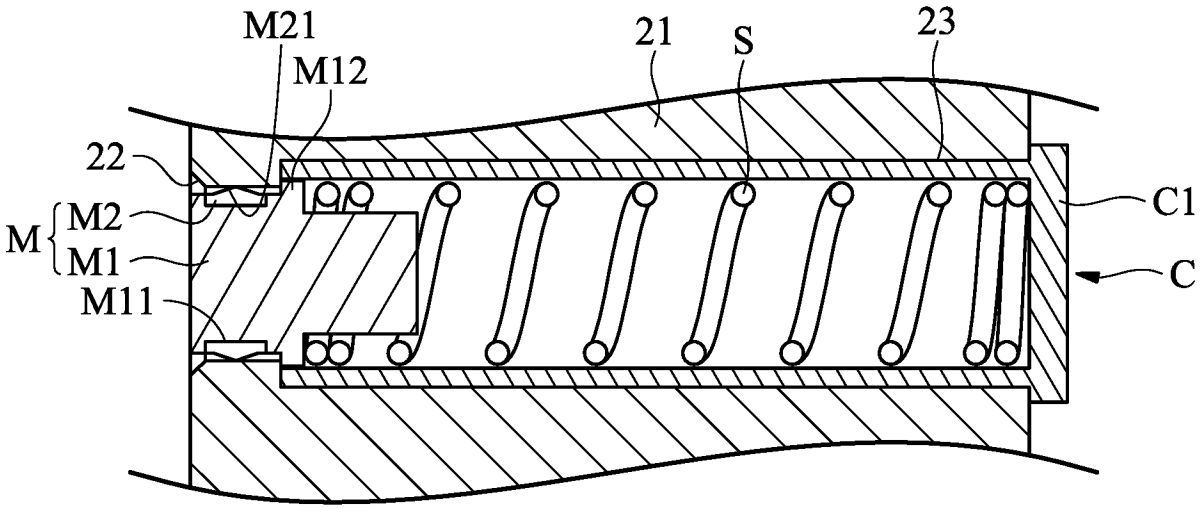
FIG. 5 is a partial enlarged cross-sectional view of the male connector in FIG. 1.

It should be realized that the sliding unit M is slidably received in the conductive seat C, and the two ends of the resilient element S push against the sliding unit M and an inner surface on the bottom portion C1 of the conductive seat C, respectively. Therefore, when the conductive member 12 of the male connector 10 is inserted into the female connector 20 through the opening portion 22, the sliding unit M is pushed and slides toward the inside of the conductive seat C, and the resilient element S is in a compressed state. Additionally, when the conductive member 12 of the male connector 10 is pulled out and detached from the female connector 20, the resilient element S can provide an elastic force to the sliding unit M, so that the sliding unit M returns to an initial state as shown in FIG. 5. It should be noted that the internal diameter of the opening portion 22 is shorter than the internal diameter of the conductive seat C, so as to secure the conductive seat C in the chamber 23 and prevent the conductive seat C from being separated from the female connector 20 through the opening portion 22.

Figure 4:
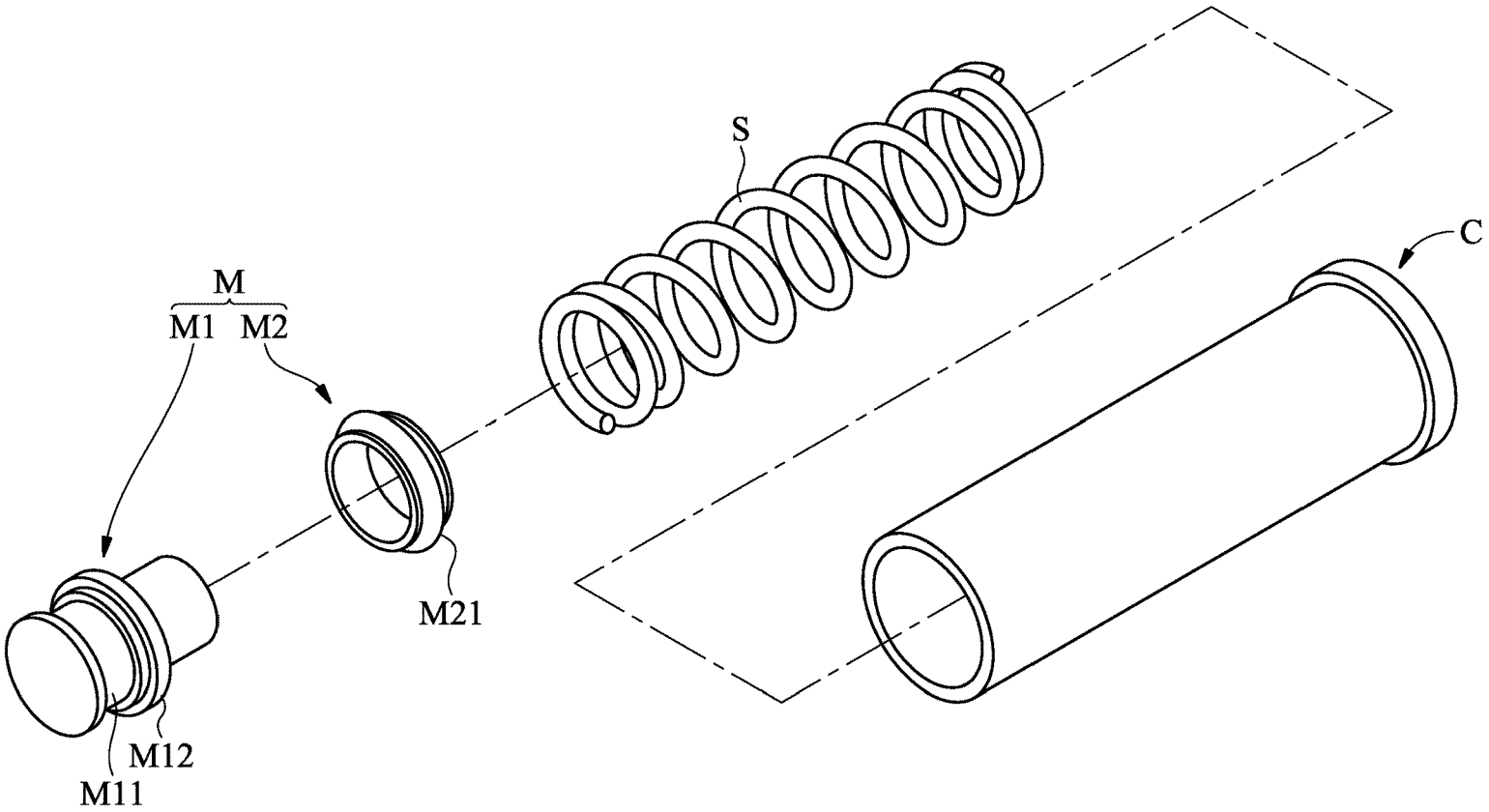
FIG. 4 is an exploded diagram of the conductive seat, the resilient element, and the sliding unit in FIGS. 3A and 3B.

As shown in FIGS. 4 and 5, the resilient element S in this embodiment may be a compression spring, and the sliding unit M comprises a slider M1 and a flexible sealing ring M2. Specifically, the slider M1 forms an annular recess M11 and a flange M12, wherein the sealing ring M2 is disposed in the recess M11 and around the slider M1. When the sliding unit M is situated in the initial state as shown in FIG. 5, a protruding portion M21 of the sealing ring M2 can form a seal with the inner surface of the opening portion 22, thereby preventing water or foreign objects from entering the chamber 23 via the opening portion 22. Additionally, the flange M12 of the slider M1 can contact a side surface of the opening portion 22, so as to restrict the sliding unit M in the opening portion 22 and prevent the sliding unit M from being separated from the female connector 20 through the opening portion 22. In an exemplary embodiment, the slider M1 and the sealing ring M2 may comprise plastic, rubber, or another electrically insulating material to prevent short-circuits and achieve a good seal.

Figure 6:
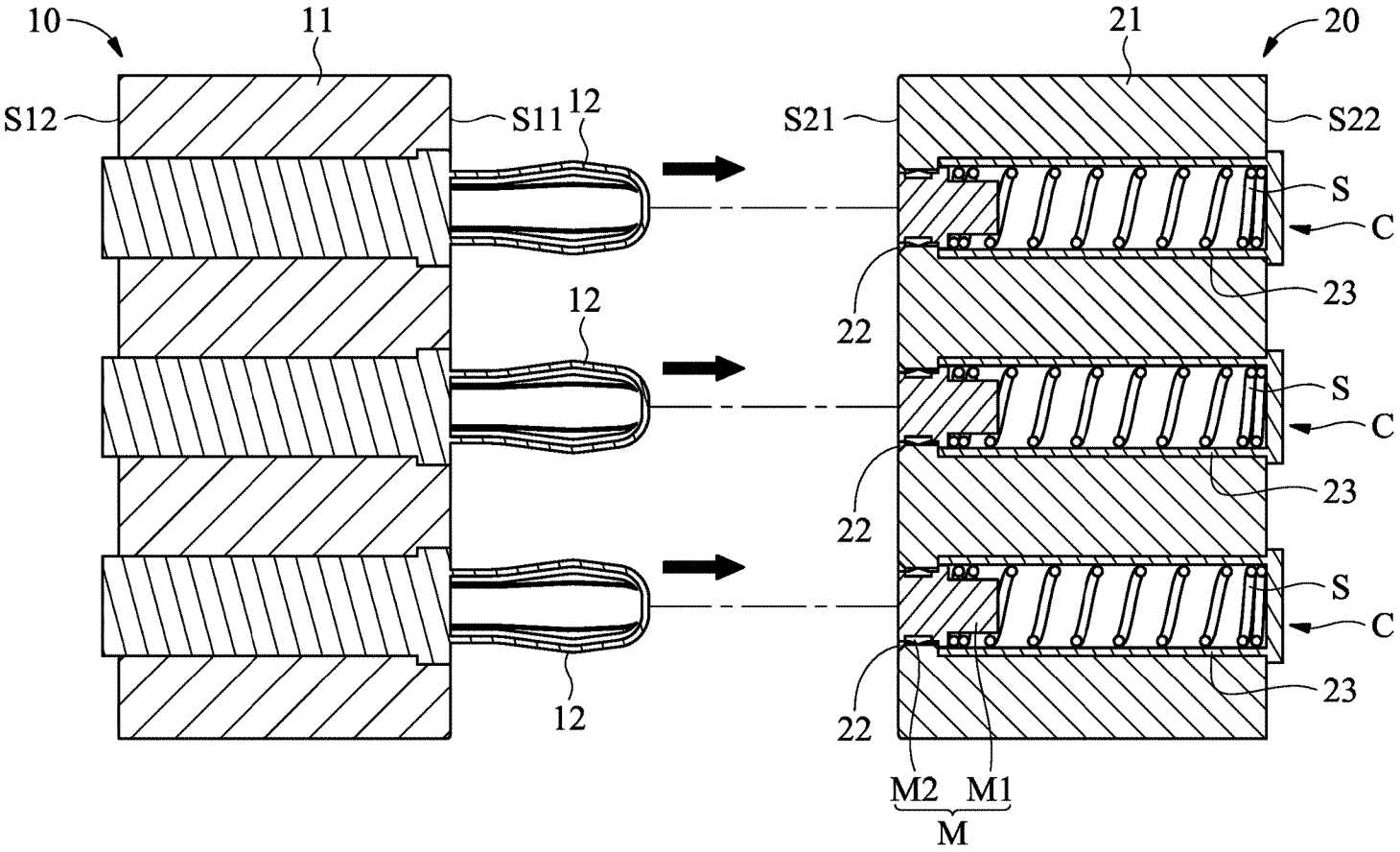
FIG. 6 is a cross-sectional view of the male and female connectors in FIG. 1 before they are joined to each other.
Figure 7:
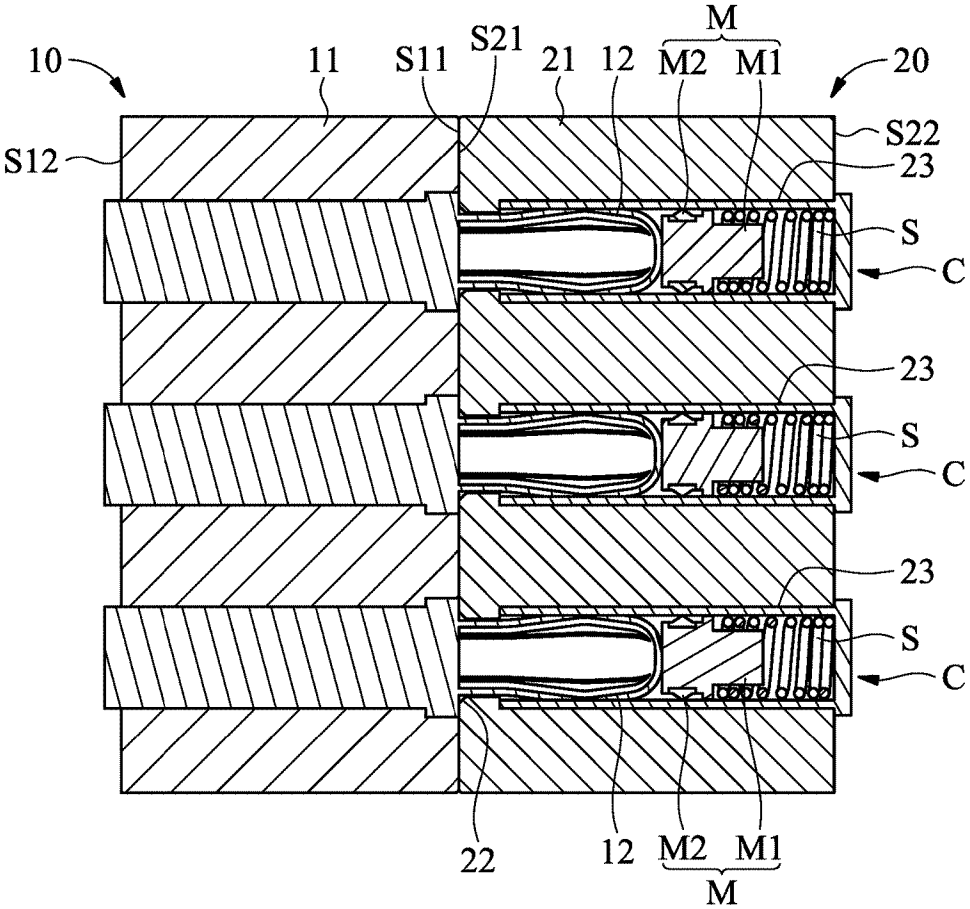
FIG. 7 is a cross-sectional view of the male and female connectors in FIG. 1 after they are joined to each other.

Referring to FIGS. 6 and 7, the conductive members 12 protruding from the first end surface S11 can be oriented toward the opening portions 22 of the female connector 10 (FIG. 6) in advance before joining the male connector 10 to the female connector 20. Subsequently, the conductive members 12 can be inserted into the conductive seats C through the corresponding opening portions 22 (FIG. 7), so that the conductive members 12 are in electrical contact with the inner surfaces of the conductive seats C, to facilitate electrical communication between the male and female connectors 10 and 20.

FIG. 7 clearly shows that a part of each conductive member 12 protrudes from the first end surface S11 and forms a flexible banana connector terminal, which can be pressed and deformed when inserted into the conductive seat C. Thus, physical contact between the conductive member 12 and the inner surface of the conductive seat C can be ensured to achieve electrical signal communication between the male and female connectors 10 and 20. During the insertion of the conductive member 12 into the conductive seat C, the sliding unit M is pushed by the conductive member 12 and slid toward the inside of the conductive seat C, and the resilient element S is in the compressed state, wherein the protruding portion M21 of the sealing ring M2 remains sealed with the inner surface of the conductive seat C, so as to prevent water or foreign objects from entering the bottom of the conductive seat C.

When the male and female connectors 10 and 20 are completely joined to each other (FIG. 7), the first end surface S11 of the male connector 10 and the third end surface S21 of the female connector 20 can contact and form a seal with each other to prevent water or foreign objects from entering the chamber 23 via the opening portion 22 to efficiently avoid short-circuits and the formation of rust on the male and female connectors 10 and 20.

In summary, an electrical connecting assembly is provided, comprising a male connector and a female connector corresponding to the male connector. By arranging a hollow conductive seat, a resilient element, and a sliding unit in the female connector, water and foreign objects can be prevented from entering the conductive seat C via an opening portion of the female connector. Specifically, the resilient element can provide an elastic force to the sliding unit, so that the sliding unit can move back into a position in the opening portion and form a seal with the opening portion. Hence, dust-proof and water-resistant functionality can be achieved no matter whether the female connector is in use or not, thereby facilitating convenience and safety of usage.

While the invention has been described by way of example and in terms of preferred embodiment, it should to be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An electrical connecting assembly, comprising:

a male connector, having a first insulating body and a conductive member protruding from the first insulating body; and a female connector corresponding to the male connector, having a second insulating body, a hollow conductive seat, a resilient element, and a sliding unit, wherein the second insulating body has an opening portion and a chamber for receiving the conductive member, the conductive seat is disposed in the chamber, the sliding unit is movably disposed in the conductive seat, and the resilient element connects the sliding unit to the conductive seat;

wherein the internal diameter of the opening portion is shorter than the internal diameter of the conductive seat, and the resilient element provides an elastic force to move the sliding unit to the opening portion and form a seal with the opening portion wherein the sliding unit as a slider and flexible sealing ring disposed around the slider, and when the resilient element provides that elastic force to move the sliding unit to the opening portion, the sealing ring forms a seal with an inner surface of the opening portion.

2. The electrical connecting assembly as claimed in claim 1, wherein the slider has a flange abutting a side surface of the opening portion to restrict the sliding unit in the opening portion when the resilient element provides the elastic force to move the sliding unit to the opening portion.

3. The electrical connecting assembly as claimed in claim 1, wherein the slider and the sealing ring comprise an electrically insulating material.

4. The electrical connecting assembly as claimed in claim 1, wherein when the conductive member is inserted through the opening portion into the chamber, the conductive member pushes the sliding unit toward the inside of the chamber and is in contact with an inner surface of the conductive seat.

5. The electrical connecting assembly as claimed in claim 4, wherein the sliding unit has a slider and a flexible sealing ring disposed around the slider, and when the conductive member is inserted through the opening portion into the chamber, the sealing ring forms a seal with the inner surface of the conductive seat.

6. The electrical connecting assembly as claimed in claim 1, wherein the first insulating body has a first end surface and a second end surface, and the second insulating body has a third end surface and a fourth end surface, wherein the conductive member extends from the first end to the second end, the opening portion is disposed on the third end surface, and the conductive seat is exposed to the fourth end surface, wherein the first end surface abuts the third surface when the male connector is joined to the female connector.

7. The electrical connecting assembly as claimed in claim 1, wherein a part of the conductive member forms a banana connector terminal.

8. The electrical connecting assembly as claimed in claim 1, wherein the resilient element comprises a compression spring.

9. The electrical connecting assembly as claimed in claim 1, wherein the first and second insulating bodies have a cylindrical structure.

10. An electrical connecting assembly, comprising:

a male connector, having a first insulating body and a conductive member protruding from the first insulating body; and a female connector corresponding to the male connector, having a second insulating body, a hollow conductive seat, a resilient element, and sliding unit, wherein the second insulating body has an opening portion and a chamber adjacent to the opening portion for receiving the conductive member, the conductive seat is disposed in the chamber, the sliding unit is movably disposed in the conductive seat, and the resilient element connects the sliding unit and the conductive seat;

wherein the sliding unit has a flexible sealing ring, and when the resilient element provides an elastic force to move the sliding unit to the opening portion, the sealing ring forms a seal with the operation portion, wherein the sliding unit further has a slider, and the sealing ring is disposed around the slider.

11. The electrical connecting assembly as claimed in claim 10, wherein the slider has a flange abutting a side surface of the opening portion to restrict the sliding unit in the opening portion when the resilient element provides the elastic force to move the sliding unit to the opening portion.

12. The electrical connecting assembly as claimed in claim 10, wherein the slider and the sealing ring comprise electrically insulating material.

13. The electrical connecting assembly as claimed in claim 10, wherein when the conductive member is inserted through the opening portion into the chamber, the conductive member pushes the sliding unit toward the inside of the chamber and is in contact with an inner surface of the conductive seat.

14. The electrical connecting assembly as claimed in claim 13, wherein the sliding unit further has a slider, and the sealing ring is disposed around the slider, wherein when the conductive member is inserted through the opening portion into the chamber, the sealing ring forms a seal with the inner surface of the conductive seat.

15. The electrical connecting assembly as claimed in claim 10, wherein the first insulating body has a first end surface and a second end surface, and the second insulating body has a third end surface and a fourth end surface, wherein the conductive member is extended from the first end to the second end, the opening portion is disposed on the third end surface, and the conductive seat is exposed to the fourth end surface, wherein the first end surface abuts the third surface when the male connector is joined to the female connector.

16. The electrical connecting assembly as claimed in claim 10, wherein a part of the conductive member forms a banana connector terminal.

17. The electrical connecting assembly as claimed in claim 10, wherein the resilient element comprises a compression spring.

18. The electrical connecting assembly as claimed in claim 10, wherein the first and second insulating bodies have a cylindrical structure.

* * * * *